United States Patent [19]

Ogle et al.

[11] 4,109,180

[45] Aug. 22, 1978

[54] AC-POWERED DISPLAY SYSTEM WITH VOLTAGE LIMITATION

[75] Inventors: James A. Ogle, Neshanic Station; James Y. Lee, Kendall Park, both of N.J.

[73] Assignee: Burroughs Corporation, Detroit, Mich.

[21] Appl. No.: 809,357

[22] Filed: Jun. 23, 1977

[51] Int. Cl.[2] ..... H05B 37/00; H05B 39/00; H05B 41/00

[52] U.S. Cl. ..... 315/169 TV; 340/324 M; 315/307

[58] Field of Search ..... 315/169 R, 169 TV, 306, 315/307; 307/237; 340/248 C, 324 M

[56] References Cited

U.S. PATENT DOCUMENTS

| | | | |
|---|---|---|---|
| 3,749,976 | 7/1973 | Colyn | 315/306 X |
| 3,794,881 | 2/1974 | Janssen | 315/84.6 |
| 3,824,582 | 7/1974 | Glaser et al. | 315/169 R X |
| 4,024,429 | 5/1977 | Glaser | 315/169 TV |

*Primary Examiner*—Alfred E. Smith
*Assistant Examiner*—Robert E. Wise
*Attorney, Agent, or Firm*—Gerald J. Woloson; Edward J. Feeney, Jr.; Kevin R. Peterson

[57] ABSTRACT

An AC-powered display system includes a gas discharge display panel, an integrated circuit, and a limiting network. The integrated circuit is provided as the display pattern controller. The limiting network, in response to an excessive voltage across the controller, reduces the current through the system. The reduction in system current causes the voltage across the integrated circuit to be regulated.

11 Claims, 1 Drawing Figure

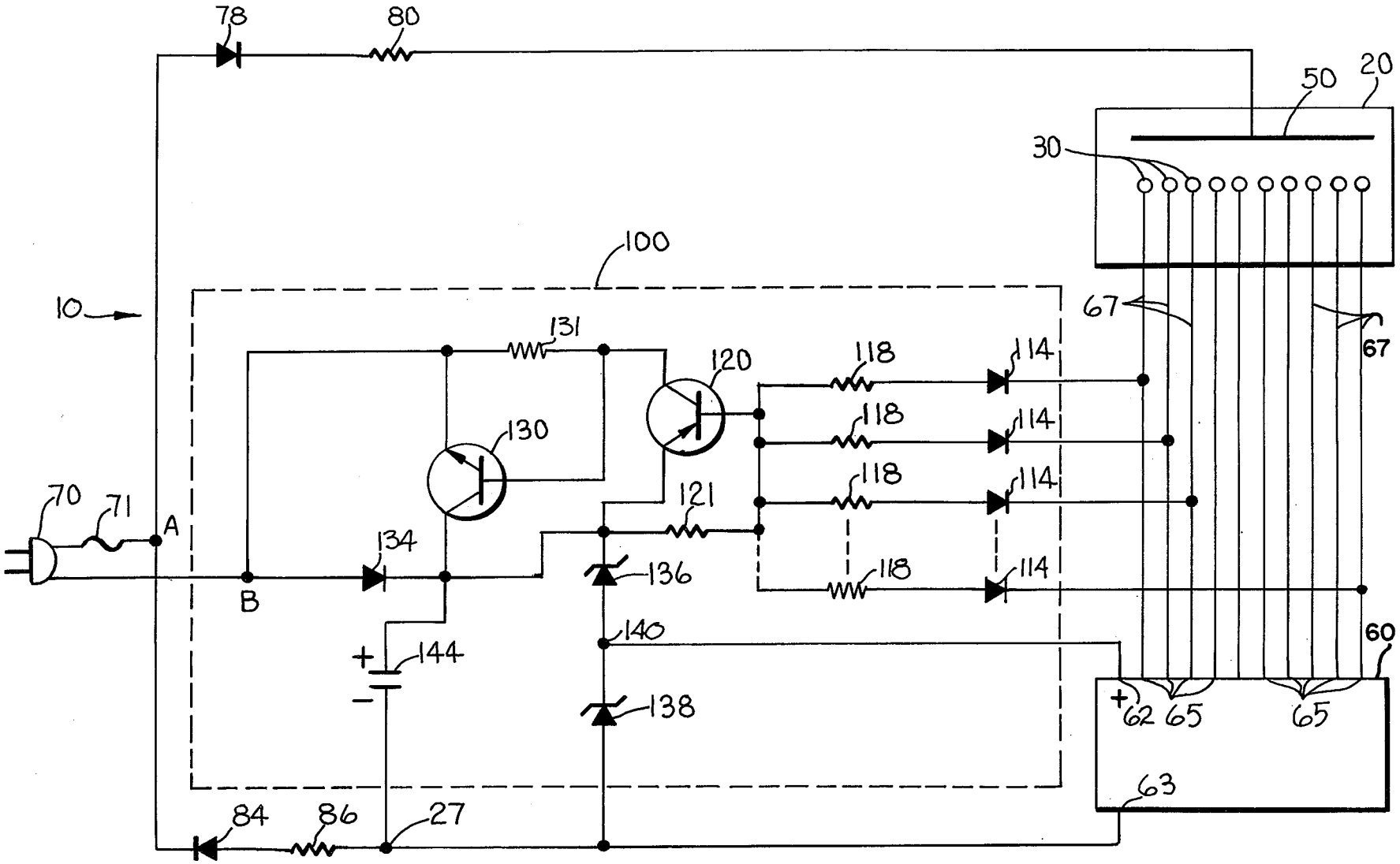
20
50
30
67
67
60
65
65
62
63
114
114
114
114
118
118
118
118
120
121
136
140
138
100
131
130
134
144
27
86
84
80
78
A
B
71
70
10

AC-POWERED DISPLAY SYSTEM WITH VOLTAGE LIMITATION

BACKGROUND OF THE INVENTION

1. Field of the Invention

The invention relates generally to the field of display systems and more specifically to those systems including gas discharge display panels.

2. Description of the Prior Art

Display systems in which gas discharge display panels provide a directly-readable luminous output are known in the art. Such systems generally include one or more of the aforementioned display panels, a circuit for controlling the panel, and a DC power supply.

A typical gas discharge display panel has one or more anodes, a plurality of cathodes associated with each anode, the combination forming a pattern, and an envelope enclosing the anodes and cathodes. An atmosphere of a low pressure gas such as mercury is also provided inside the envelope. The gas is caused to glow when a sufficiently high voltage is established between selected anodes and cathodes that a discharge occurs therebetween. The control circuit serves to energize selected anodes and cathodes which cooperate with the gas to form a glow pattern.

The DC power supply is provided to supply the necessary voltage to the selected anodes and cathodes and may also power the selection circuitry. A typical arrangement is shown, for example, in U.S. Pat. No. 3,794,881, issued to D. Janssen on Feb. 26, 1974, which discloses a circuit for providing a stable d-c voltage to the display and selecting circuit. Sometimes, for example in an electric time clock, it would be desirable to use the 60-cycle line frequency as a frequency standard, which is not immediately available with a DC power supply. A direct connection to the AC line, however, would subject the panel and the selection circuitry to fluctuations commonly encountered in the AC line.

SUMMARY

It is therefore an object of this invention to provide a particular display system directly connected to the 60-cycle AC line.

It is a further object to provide the aforementioned display system having an integrated circuit to control the display panel.

It is yet another object to provide the aforementioned display system further having a circuit for protecting the integrated circuit from severe voltage fluctuations common in the standard 60-cycle AC line .

It is still another object to provide a voltage limiting circuit for protecting the electrode selection circuitry in a display system powered by an AC power supply.

The invention provides a display system to be powered by a 60-cycle AC line including a gas discharge display panel, an integrated circuit for controlling the panel, and a circuit for limiting the voltage across the integrated circuit to a preselected level. After the AC voltage reaches a threshold level and the panel starts to glow, the voltage across the panel assumes a lower constant sustaining level. This initial change as well as further fluctuations in the AC voltage appear across the integrated circuit and the voltage limiting circuit. The limiting network monitors and limits the voltage across the integrated circuit by limiting the amount of current flowing through the display system. As a result, the integrated circuit is protected from these further voltage variations.

BRIEF DESCRIPTION OF THE DRAWINGS

The aforementioned objects and features of this invention, as well as other objects and features, will be better understood upon consideration of the following detailed description when read in conjunction with the drawing, in which:

The FIGURE is a schematic diagram of a preferred embodiment of the display system disclosed herein, including a detailed circuit diagram of the voltage limiting circuit.

DETAILED DESCRIPTION OF THE PREFERRED EMBODIMENT

With reference to the sole FIGURE, the invention provides a display apparatus 10 including a gas discharge display panel 20, an integrated circuit chip 60 for controlling the display panel, and a voltage limiting circuit 100. The display apparatus is to be powered by a standard 60 cycle 115 volt AC line. The specific embodiment described is particularly useful as a clock, wherein display panel 20 is configured as described in U.S. Pat. No. 3,824,582, issued to Glaser et al on July 16, 1974, and assigned to the assignee of the present invention. Integrated circuit 60 may comprise a digital alarm clock n-channel MOS integrated circuit such as for example, that designated CK 3000 and manufactured by the General Instrument Corporation. It should be understood, however, that the invention is not limited to the particular above-mentioned gas discharge panel, integrated circuit, or clock.

Display apparatus 10 is provided with plug 70 for connection to the AC line power supply. One side of plug 70 is connected to node A through fuse 71. Node A is connected through diode 78 and resistor 80 to anode 50 of display panel 20, the anode of diode 78 being connected to node A. Cathodes 30 of display panel 20 are connected to respective positive control pins 65 of integrated circuit 60 through lines 67. Node A is further connected through diode 84 and resistor 86 to node 27, the cathode of diode 84 being connected to node A.

The other side of plug 70 is connected to node B, which is connected to the voltage limiting circuit generally designated 100. In particular, node B is connected to the anode of diode 134. The cathode of diode 134 is connected to the collector of transistor 130, to the emitter of transistor 120, to the positive side of electrolytic capacitor 144, and to the cathode of zener diode 136. The negative side of electrolytic capacitor 144 is connected to node 27. The anode of zener diode 136 is further connected to the cathode of zener diode 138, the anode of which is also connected to node 27. Also connected to node 27 is the negative voltage input 63 to integrated circuit 60.

The positive voltage terminal 62 of integrated circuit 60 is connected to node 140. Zener diode 138 is selected so that the voltage across it is suitable to drive integrated circuit 60. Zener diode 136 is provided as an option to obtain a greater total available voltage between node B and node A as required by gas discharge display panel 20 and integrated circuit 60.

The collector of transistor 120 is connected to the base of transistor 130. Biasing resistors 131 and 121 are further provided between the emitter and base of transistor 130 and 120, respectively. The base of transistor 120 is connected through resistors 118 to the anodes of diodes 114. The cathodes of diodes 114 are connected to particular ones of lines 67 between the cathodes of gas discharge panel 20 and the control pins 65 of integrated circuit 60. Particular lines 67 are activated by integrated circuit 60 so that at any given time at least one line is conducting.

In operation, assuming first that node B is positive with respect to node A, current will flow through diode 134 and charge electrolytic capacitor 144 through resistor 86 and diode 84, the charge on electrolytic capacitor 144 being limited to the voltage determined by zener diodes 136 and 138. This capacitor voltage supplies a biasing voltage for transistors 120 and 130 through resistors 121 and 131. During the other half of the cycle, wherein node A is positive with respect to node B, a positive voltage is applied to anode 50 of gas discharge panel 20 through diode 78 and resistor 80. During this half of the cycle, diodes 84 and 134 are reverse biased and no current will flow therethrough. Charged electrolytic capacitor 144, in conjunction with diodes 114 and resistors 118, 121, and 131, biases transistors 120 and 130 so as to permit current flow therethrough to node B.

When the AC voltage reaches the potential necessary to establish a discharge across panel 20, a current path is established from node A, through diode 78 and resistor 80, between the anode 50 and cathodes 30 of discharge panel 20, between positive control pins 65 and negative voltage input 63 of integrated circuit 60, to node 27, and from node 27 through capacitor 144 and transistors 120 and 130 to node B.

It is known in the art that a higher voltage is required to establish the glow discharge though a gas discharge display panel than to sustain the discharge, and also that once a discharge is established, the voltage across the panel, between the anode and the cathodes, is constant. In the instant embodiment, therefore, once a glow discharge is established, several types of voltage changes must be compensated for. One is the initial change in panel voltage from the higher discharge-establish level to the lower sustaining level. Another is the further variation in supply voltage as the AC cycles from the point where discharge is first established to the point where firing is no longer sustained. A third is the transient variations that appear on the AC line. These voltage changes are all imposed across integrated circuit 60 and voltage limiting circuit 100.

Because of the constant post-firing differential between the anode and selected cathodes, these voltage changes appear on lines 67. An increasing voltage on these lines causes a decrease in current through diodes 114 and resistors 118. This decreases the base current through transistor 120, which in turn causes the emitter-collector current therethrough to decrease. This in turn causes the base and collector-emitter currents through transistors 130 to decrease, thereby throttling the current through the aforementioned current path. As a result, the potential applied to the anode will be limited, and the anode and the cathodes will be prevented from together rising any further in potential. Limiting the rise of the cathode voltages means that an excessive voltage drop across integrated circuit 60 is avoided.

It will occur to those skilled in the art that various modifications of the above-described preferred embodiment may be made without departing from the spirit of the invention. It is expressly understood that the scope of the invention is not limited to the embodiment disclosed herein, but only as indicated in the appended claims.

What is claimed is:

1. A display system which is to be powered by an AC power supply, and which has a first terminal and a second terminal for receiving the AC signal, comprising:
   (a) a gas discharge display panel having an anode and a plurality of cathodes, said anode being connected to said first terminal;
   (b) circuit means connected to said cathodes for energizing selected ones of said cathodes; and
   (c) voltage limiting means connected to said second terminal and to said circuit means for limiting the amount of current flowing through said display system in response to the voltage across said circuit means, to thereby limit the voltage across the circuit means to a preselected level.

2. A display system as defined in claim 1 in which said voltage limiting means includes a transistor having its base connected to selected ones of said cathodes.

3. A display system as defined in claim 2 in which each connection between said selected cathodes and the base of said transistor is through a diode, the anodes of said diodes being connected to the base of said transistor.

4. A display system as defined in claim 2 in which said voltage limiting means includes an electrolytic capacitor connected to said second terminal to be charged to a predetermined voltage when said second terminal is positive with respect to said first terminal.

5. A display system as defined in claim 4 in which said electrolytic capacitor is connected to said transistor to bias said transistor when said first terminal is positive with respect to said second terminal.

6. A display system which is to be powered by an AC power supply, and which has a first terminal and a second terminal for receiving the AC signal, comprising:
   (a) a gas discharge display panel having an anode and a plurality of cathodes forming a pattern, said anode being connected to said first terminal;
   (b) circuit means having a plurality of positive control terminals and a negative terminal, each of said positive control terminals being individually connected to one of said cathodes for selectively energizing said cathodes; and
   (c) voltage limiting means connected to said negative terminal, to said positive control terminals, and to said second terminal for limiting the amount of current flowing through said display system in response to the voltage between said positive control terminals and said negative terminal to limit the voltage therebetween to a preselected level.

7. A display system which is to be powered by an AC power supply, and which has a first terminal and a second terminal for receiving the AC signal, comprising:
   (a) a gas discharge display panel having an anode and a plurality of cathodes, said anode being connected to said first terminal;
   (b) circuit means connected to said cathodes for selectively energizing said cathodes; and
   (c) voltage limiting means including a transistor having its base connected to selected ones of said cathodes, the cathodes being selected so that at any given time at least one of the cathodes is energized, said transistor being further connected to transfer current between said circuit means and said second terminal and to limit the flow of said current in response to the voltage at said cathodes, to limit the voltage across the circuit means to a preselected level.

8. A voltage limiting circuit for use in an AC-powered display system which includes a gas discharge display panel having an anode and a plurality of cathodes and which includes a circuit for selectively energizing said cathodes, said voltage limiting circuit comprising:

(a) a transistor connected between said energizing circuit and said power supply, the base of said transistor being connected to selected ones of said cathodes, said transistor being connected so that current passing through said display system passes through said transistor; and (b) mean for biasing said transistor to conduct when the voltage on said cathodes is low, said transistor serving to throttle the current through the display system in response to the increase of the voltage on the cathodes to limit the voltage across the energizing circuit to a preselected level.

9. The voltage limiting circuit as defined in claim 8 in which said biasing means includes a capacitor.

10. The voltage limiting circuit as defined in claim 9 in which the capacitor is charged to a preselected voltage during half of the AC cycle.

11. The voltage limiting circuit defined in claim 8 in which the base of said transistor is connected to said cathodes through respective diodes.

* * * * *